United States Patent [19]

Granryd et al.

[11] Patent Number: 4,787,441

[45] Date of Patent: Nov. 29, 1988

[54] HEAT TRANSFER ELEMENT

[76] Inventors: Eric Granryd, Slatthallsvagen 2, S-183 65 Taby; Bjorn Palm, Tomtbergavagen 10, S-141 43 Huddinge, both of Sweden

[21] Appl. No.: 71,126

[22] Filed: Jul. 8, 1987

[30] Foreign Application Priority Data

Jul. 24, 1986 [SE] Sweden ..... 8603206

[51] Int. Cl.[4] ..... F28F 13/00

[52] U.S. Cl. ..... 165/133; 165/104.26

[58] Field of Search ..... 165/133, 104.26; 62/527

[56] References Cited

U.S. PATENT DOCUMENTS

| | | | |
|---|---|---|---|
| 2,941,759 | 6/1960 | Rice et al. | 165/133 X |
| 3,684,007 | 8/1972 | Ragi | 165/133 |
| 4,434,842 | 3/1984 | Gregory | 165/133 |

FOREIGN PATENT DOCUMENTS

| | | | |
|---|---|---|---|
| 2811387 | 9/1978 | Fed. Rep. of Germany | 165/133 |
| 148194 | 9/1982 | Japan | 165/133 |
| 33098 | 2/1983 | Japan | 165/133 |
| 2677 | 1/1985 | Japan | 165/133 |

*Primary Examiner*—Ira S. Lazarus

*Assistant Examiner*—Peggy Neils

*Attorney, Agent, or Firm*—Sughrue, Mion, Zinn, Macpeak, and Seas

[57] ABSTRACT

A heat exchanger wall incorporates a partition wall (11–12), one side of which is in contact with a heat exchange medium. A mechanically stable part (11) of the partition wall (11–12) has provided on one surface thereof a thin metal foil (12), which is provided with a large number of small through-passing holes (121) and which is attached directly to the said part (11), such as to form a minute gap (13) between the foil and the mechanically stable part. According to one embodiment the element comprises a tube (11) and the foil has provided therein a longitudinally extending slot (122) and/or a plurality of folds or bends (31, 32) directed towards the stable part (11), and/or a fold or bend (51) facing away from the stable part (11). In addition to occurring through the intrinsic rigidity of the foil, the thin gap is formed by providing one side of the foil (12) with a rough or irregular structure, or by forming the holes in the foil in a manner such as to leave burrs around the defining edges of the holes, or by providing in the foil a number of folds or bends (31, 32) which face towards the mechanically stable part.

9 Claims, 2 Drawing Sheets

Fig. 6
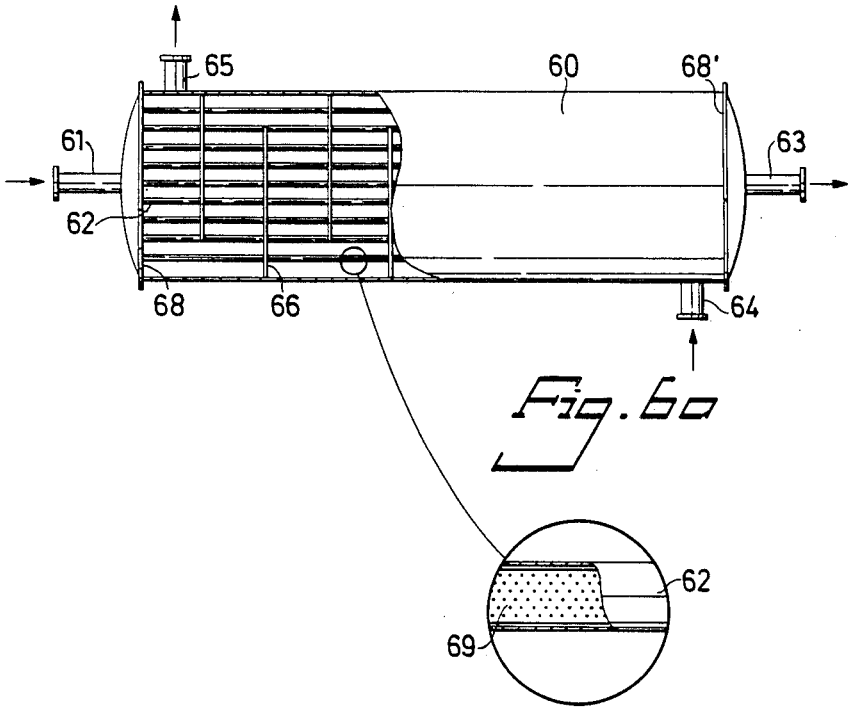
Fig. 6a
Fig. 7
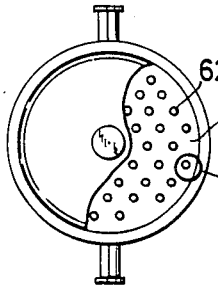
Fig. 7a
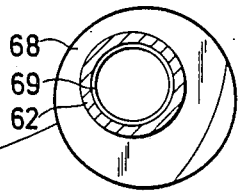

HEAT TRANSFER ELEMENT

TECHNICAL FIELD

The present invention relates to a heat transfer wall for a heat exchanger for improving the heat transfer coefficient in boiling and condensing conditions.

Conceivable fields in which the invention can be applied include the evaporators of refrigerating systems, heat pumps, ice-making machines, air-conditioning plants and like systems, i.e. in heat-exchanges through boiling, although the reverse can also be applied, i.e. in heat-exchanges through condensation.

The object of the present invention is to provide a wall or an element which, although small in size and light in weight, has a large heat transfer capacity per unit of surface area at relatively small temperature differences between the media between which heat transfer is to take place, i.e. the element has a high heat transfer coefficient defined as transferred thermal energy per $m^2$ for each degree of difference in the temperatures between liquid and hot surface in the case of boiling or between gas and cooled surface in the case of condensation.

BACKGROUND PRIOR ART

Many various kinds of heat transfer walls for heat exchangers are known to the art. For example, there is described and illustrated in German Patent Specification No. 2343523 a tube through which a liquid is conducted and the wall of which presents a multiple of helically positioned channels, through which fine orifices communicate with the surroundings within which the tube is located.

Another type of heat transfer element is found described in U.S. Pat. No. 4,434,842, this element comprising a base plate on which there are welded two corrugated aluminium plates which partly overlap one another and which are provided with a large number of apertures.

The Japanese Patent Application No. 50-85333 describes and illustrates a thermal tube, the outer zone of which comprises a fibre mass having a large number of apertures up to the outer surface.

Many further examples of more or less complicated heat transfer elements are available in those patent classes to which the aforementioned inventions belong. The object of the present invention is, as indicated in the introduction, to provide a heat transfer element having a high heat transfer coefficient and which is of simple construction and of inexpensive manufacture.

SUMMARY OF THE INVENTION

In accordance with the present invention the partition wall in a heat transfer element of the aforesaid kind includes a mechanically stable part having provided on one side thereof a thin metal foil, in which a large number of small apertures are formed. The foil is directly arranged on the surface of the stable part, thus providing the minute gap, which is essential for the function of the heat exchanger. The thin, minute gap is formed between the mechanically stable part and the foil is not joined by welding, adhesives or the like to the stable part.

These and other characterizing features of an element constructed in accordance with the invention are set forth in the following claims.

BRIEF DESCRIPTION OF THE DRAWINGS

The invention will now be described in more detail with reference to the accompanying drawings, in which.

FIG. 6 is a partial sectional front view of a tube boiler evaporator;

FIG. 6*a* is a partial sectional view of an enlarged part of a tube forming part of the evaporator illustrated in FIG. 6;

FIG. 7 is a part sectional side view of the tube boiler evaporator illustrated in FIG. 6; and FIG. 7*a* is a sectional side view of a tube forming part of the evaporator illustrated in FIGS. 6–7.

DESCRIPTION OF A PREFERRED EMBODIMENT

Figure 1:
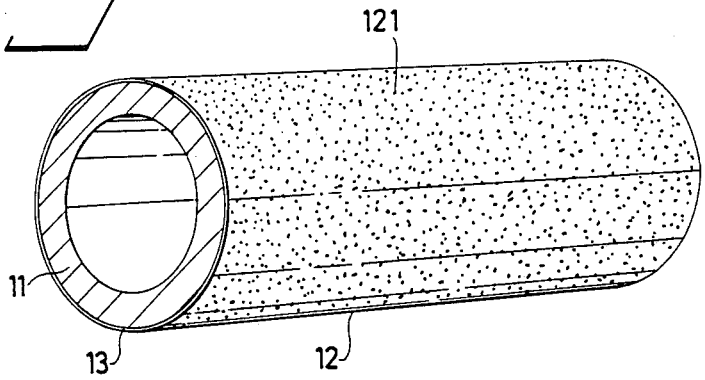
FIG. 1 is a side view of a tubular element having a thin foil member attached to the outer surface of the element.

FIG. 1 illustrates part of a heat transfer element or wall according to the invention comprising a tube 11 having attached to the outer surface thereof a metal foil 12 in which a large number of through-passing holes 121 are formed. The tube comprises a mechanically stable part and the metal foil is directly arranged on the stable part. A thin, minute gap 13 is therefore provided between the tube 11 and the foil 12. The gap is normally not continuous, because some portions or spots of the foil are in close contact with the tube 11 and the remaining surface of the foil forms a gap with varying thickness or height, which preferably is less than 0.1 mm. With regard to the dimensions of the metal foil and the through-passing holes it can be mentioned that the metal foil may have a thickness of about 0.03 mm and that the holes may have a diameter of about 0.2 mm, with at least ten holes per $cm^2$ of surface. The thickness of the foil ranges between 0.01 and 0.1 mm, the diameter of the holes between 0.05 and 0.5 mm and the number of holes between 10 to 100 holes/$cm^2$.

This wall can be used for heat transfer purposes with "external vaporization", by placing the wall in an apparatus in which the wall is flushed externally with a refrigerant, e.g. dichlorodifluoromethane (retained under designation R12), said refrigerant being vaporized in the proximity of the outer tubular wall and by passing through the tube a calcium chloride solution for example, having a temperature of −5° C.

Figure 2:
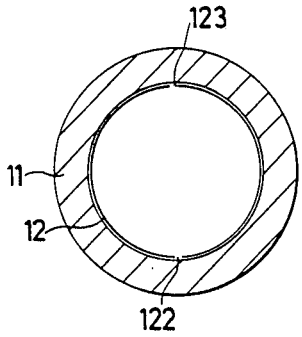
FIG. 2 is a sectional view of a tubular element having a thin foil member attached to the inner surface of the element.

Vaporization, however, can also be effected internally of a tubular element, as illustrated in FIG. 2, which shows a section of a tube 11 having a thin foil member 12 attached to the inner surface thereof. This foil has two slots extending longitudinally thereof, i.e. a slot 122 at the bottom and a slot 123 at the top.

Figure 3:
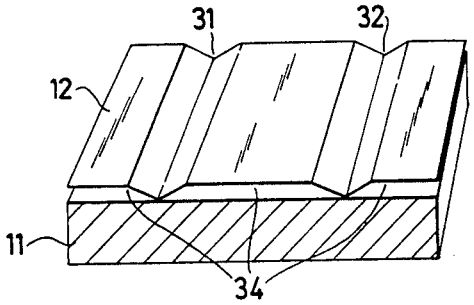
FIG. 3 is a sectional view of part of a flat element provided with a thin foil member having provided thereon a multiple of folds directed towards the mechanically stable part.

FIG. 3 illustrates an embodiment of a heat transfer element which comprises a thin foil 12 having formed therein a plurality of folds 31, 32, the apices of which folds are directed towards a mechanically stable part 11. The foil is positioned so as to form between the stable part 11 and the foil 12 a space 34 which, nearest the folds 31, 32, has a wedge-like character and which is intended to conduct a liquid flow of heat exchange medium. This embodiment incorporating folds 31, 32, is particularly suited for heat transfer by condensation, the folds being formed with a direction which coincides with the flow direction of condensate, thereby effectively draining away condensate through naturally occurring capillary forces. The holes in the foil should be of larger diameter in the case of condensation than in the case of boiling.

Figure 4:
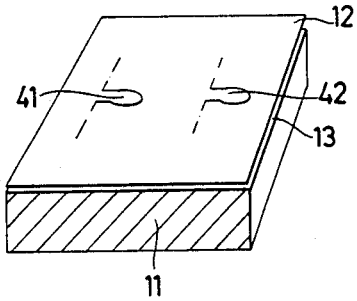
FIG. 4 illustrates part of an element in which the thin foil member is provided with a multiple of resilient tongues.

When effecting heat transfer with high surface energies—vigorous boiling—a continuous gas film is formed between the foil and the hot wall. This gaseous film drastically impairs the heat transfer properties. In order to overcome this, the foil is conveniently punched so as to form tongues which function as valves. With high energies, the pressure between the foil and the hot surface increases and the tongues will open automatically and allow gas to pass through. FIG. 4 illustrates part of a flat heat transfer wall having a mechanically stable part 11, a foil 12 and a narrow gap 13 between the stable part 11 and the foil 12. The foil 12 has a plurality of resilient tongues 41, 42 punched therein. In the event of an overpressure between the stable part 11 and the foil 12, one or more of the flaps will open by bending around the base line of respective flaps, therewith equalizing the pressure.

Figure 5:
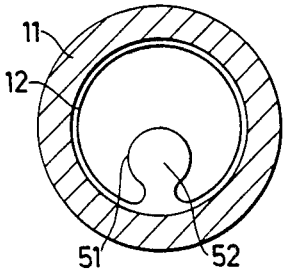
FIG. 5 is a sectional view of a tubular element having a thin foil member attached to the inner surface of the element, the foil member having a longitudinally extending fold directed away from the mechanically stable part.

In the case of tubular heat transfer elements with which the foil member is attached to the inner surface of the tube, the foil may conveniently be curved or folded away from the tube in a direction longitudinally therealong, in a manner to provide a channel for conducting a heat transfer medium in liquid phase. One such embodiment is illustrated in FIG. 5, in which the foil member is folded to form a part-cylindrical channel 51 providing space 52 for conducting a liquid. This fold also facilitates insertion of the foil into the tube.

The foil member can be applied to the substrate tube surface in many different ways. For example, the foil may comprise a spring material such as bronze, for example, and be given a form such as to ensure that it will be held firmly to the substrate surface through its own spring function, once having been applied thereto. Alternatively, the foil may be secured in position by means of a separate spring device pressing the foil against the rigid tube 11. When fixing the foil on or in a tube this spring device may comprise a coil spring.

In order to provide an even height of the gap between the foil 12 and the mechanically stable part 11 the foil may be formed by providing the side of the foil facing the mechanically stable part with a rough or irregular structure. This structure may be provided when the through-passing holes are formed in the foil member by ensuring that burrs are formed which subsequently lie against the mechanically stable part 11. It should, however, be noted that a "rough" structure is not an absolute condition for obtaining the function, but in some cases an improvement can be reached.

One example of the use to which a heat transfer element according to the invention can be put in practice is illustrated in FIGS. 6 and 7, which are respectively part sectional front and side views of a traditional tube boiler evaporator provided with a foil-element according to the invention. The evaporator may be part of a heat pump system or a refrigerating system, and comprises a cylindrical tank 60 having passing therethrough a large number of tubes 62, attached to end walls 68—68'. A refrigerant, e.g. R12, is passed through the tubes and vaporized during its passage therethrough. The refrigerant is supplied to an inlet 61 and removed at an outlet 63. A cold carrier, e.g. water, is circulated externally around the tubes, said carrier being introduced through an inlet 64 and removed through an outlet 65. Passage of the cold carrier through the tank 60 is guided conveniently by baffles 66.

The enlarged views shown in FIGS. 6*a* and 7*a* illustrate the positioning of a perforated foil 69 in tube 62, c.f. also FIG. 2.

The nature of the material used to form the metal foil is selected in accordance with the practical use to which the invention is put. Aluminium is normally a suitable material in this regard. If the foil is to have resiliency, then bronze or stainless steel should be chosen.

What is claimed:

1. A heat transfer wall for a heat exchanger, at least one surface of which being in contact with a heat exchange medium, of the type changing its phase state during heat exchanging, characterized in that said wall comprises a mechanically stable, smooth part (11), one surface of which being provided with a thin metal, flexible foil which is directly applied to the mechanically stable part without any intermediate means so as to create between the mechanically stable part and the thin metal foil a minute gap or spacing, and in that said thin metal foil (12) has a large number of through-passing holes (121) formed therein.

2. A wall according to claim 1, characterized in that the mechanically stable part comprises a tube having an outer surface (11); and in that the foil (12) is attached to the outer surface of the mechanically stable part.

3. A wall according to claim 1, characterized in that the mechanically stable part comprises a tube having an inside surface (11); and in that the foil (12) is attached to the inside surface of the mechanically stable part.

4. A wall according to claim 3, characterized in that the foil (12) has at least one slot (122) extending longitudinally therealong.

5. A wall according to any of claims 1–3, characterized in that the foil (12) presents a number of folds or bends (31, 32) directed towards the mechanically stable part (11), thereby to form between the stable part (11) and the foil a space (34), which space has a wedge-shaped character nearest the folds or bends (31, 32).

6. A wall according to claim 1, characterized in that the foil (12) has a plurality of resilient tongues (41, 42) formed therein.

7. A wall according to claim 1, characterized in that the surface of the foil facing the mechanically stable part has a rough or irregular structure.

8. A wall according to claim 1, characterized in that the holes are formed in the foil so as to leave burrs, said burrs being intended to lie against the mechanically stable part so as to form said thin gap.

9. A wall according to claim 1, characterized in that the foil has a thickness between 0.01 mm and 0.1 mm, preferably a thickness of 0.03 mm; in that the holes have a diameter between 0.05 mm and 0.5 mm, preferably a diameter of 0.2 mm; and in that the number of holes per surface area of the foil lies within the range of ten holes per $cm^2$—one hundred holes per $cm^2$.

* * * * *